United States Patent [19]

Nelson et al.

[11] Patent Number: 4,603,661

[45] Date of Patent: Aug. 5, 1986

[54] HYDROBLAST CYCLONE CLEANER APPARATUS AND METHOD

[75] Inventors: Charles R. Nelson, Morris; Cris R. Lehman, Dwight, both of Ill.

[73] Assignee: Halliburton Company, Duncan, Okla.

[21] Appl. No.: 688,221

[22] Filed: Jan. 2, 1985

[51] Int. Cl.[4] ..... F22B 37/52

[52] U.S. Cl. ..... 122/392; 15/316 R; 122/405; 134/167 C; 134/168 C; 134/172; 134/198; 165/95

[58] Field of Search ..... 122/379, 382, 390, 391, 122/392, 396, 405; 15/316 R, 316 A, 317, 318 A, 104.04, 104.05; 134/167 C, 167 R, 168 R, 168 C, 169 R, 172, 188, 198; 165/95

[56] References Cited

U.S. PATENT DOCUMENTS

| | | | |
|---|---|---|---|
| 3,541,999 | 11/1970 | Winkin et al. | 122/392 |
| 3,661,124 | 5/1972 | Winkin | 122/392 |
| 3,701,341 | 10/1972 | Willis, Jr. | 122/392 |
| 4,095,305 | 6/1978 | Goodwin | 134/167 C |
| 4,273,076 | 6/1981 | Lahoda et al. | 122/382 |
| 4,354,294 | 10/1982 | Silver | 122/392 |
| 4,407,236 | 10/1983 | Schukei et al. | 122/382 |
| 4,445,465 | 5/1984 | Byrd et al. | 122/382 X |
| 4,498,427 | 2/1985 | Todd | 122/379 |
| 4,503,811 | 3/1985 | Hammond | 122/382 X |
| 4,527,515 | 7/1985 | Hester, II | 122/382 X |

*Primary Examiner*—Albert J. Makay
*Assistant Examiner*—Steven E. Warner
*Attorney, Agent, or Firm*—Edward F. Sherer

[57] ABSTRACT

An externally controllable apparatus for cleaning the slag deposits from the inner surfaces of a cyclone burner includes a support structure having a carriage slidably mounted thereon. A fluid-conducting swivel is mounted on the carriage for providing a rotatable coupling to a pipe extending through the cyclone. The carriage is moved along the support by a suitable movement mechanism so that fluid lances movably mounted on the pipe are properly disposed at selectable longitudinal positions within the cyclone burner. The fluid lances are transversely movable so that they can be moved toward or away from the side wall of the cyclone burner. A plurality of pairs of nozzles are used for directing a spray of cleaning fluid toward respective portions of the cyclone. One pair of nozzles is connected to the fluid lances to clean the inner surfaces of the end walls of the cyclone, another pair is connected to the fluid lances to clean the inner surfaces of the inlet and outlet walls and the facing portions of the side wall, and a third pair is connected to the fluid lances to clean the portion of the side wall which extends between the inner mouths of the inlet and outlet walls. The method of cleaning the cyclone utilizes this apparatus to clean these different areas during different time periods.

19 Claims, 12 Drawing Figures

HYDROBLAST CYCLONE CLEANER APPARATUS AND METHOD

BACKGROUND OF THE INVENTION

This invention relates generally to apparatus and methods for cleaning cyclone burners and more particularly, but not by way of limitation, to externally controllable apparatus and methods for cleaning slag from the inner surfaces of a coal-fed cyclone burner attached to a boiler.

Coal-fired boilers are used by utility companies, for example, to heat water for generating steam which drives electric generators. Pulverized coal is fed into one of such boilers through a cyclone burner which receives the pulverized coal from a feeder apparatus connected to the inlet of the cyclone burner. Initial burning occurs inside the cyclone burner with further burning occurring in the boiler.

Burning of the coal creates iron slag deposits (sometimes up to 2–3 feet, for example) on the inside walls of the cyclone. Although some amount of slag is known to assist the combustion, too much is detrimental. Therefore, the inside surfaces of the cyclone need to be cleaned generally at least one time per year to reduce the deposits to the desired level or thickness.

Because of the hardness of the slag deposits, jackhammers, welding hammers, pry bars and the like have been used to remove the slag; however, such implements have worn out large crews of men working with these tools for periods of one week or more. Use of such tools is not only tiring, but also dangerous because sparks and loosened debris fly when the metal tools impact the hard iron deposits.

High pressure cleaning fluids, such as water, have also been used to remove slag from the cyclone walls. In cleaning a cyclone by this technique, a person stands on the inside of the cyclone and holds a spray gun which ejects the cleaning fluid in a 10,000 to 14,000 pound per square inch stream. This technique is hazardous because it is very difficult for the person to stand on the generally curved, slag-covered side of the generally cylindrical cyclone while operating a hand-held spray gun ejecting a thin stream of cleaning fluid at a pressure between 10,000 to 14,000 pounds per square inch. This technique is also hazardous because it creates flying debris whirling around the person inside the cyclone, which flying debris necessitates that the person wear thick, heavy, hot protective clothing and headgear.

This technique is also time-consuming, taking up to two days or more. This is brought about, at least in part, by the thin stream of fluid which must be used so that a person can hold and maneuver the spray gun and yet have a large enough force to remove the slag from the cyclone surfaces.

Because of the strenuous work, large crews of people are needed so that each individual can rotate every few hours. For example, a crew of six men per cyclone per 24-hour period, with each man rotating every one to two hours, has been known to be used.

This technique also makes it difficult to obtain a consistent cleaning from one cyclone to the next because of the construction of the cyclone with its inwardly projecting inlet and outlet cones and also because the use of people to hold and direct the spray guns prevents precisely controlled cleaning from job to job.

The disadvantages of the aforementioned manual techniques using metallic tools or hand-held, high pressure spray guns create the need for a safer technique of cleaing the inner surfaces of cyclones without using people inside the cyclones. Meeting this need would reduce the chances of injury to personnel. There is also the need for a technique which can clean the cyclone more quickly without requiring as much manpower and man-hours of labor. There is also the need for a more precise technique of cleaning to insure consistent cleaning jobs from one cyclone to the next despite the construction of each cyclone. While achieving the aforementioned needs, it is also desirable to have a technique by which the cyclones can be cleaned more economically.

Despite the aforementioned disadvantages of the previous techniques and the need for a new technique which does not have these disadvantages, we have been told over the years by those in the industry that an automated system meeting these needs, whereby a cyclone could be more effectively cleaned, could not be built. Such pessimism has also indicated that it is not possible to adequately clean a cylone with a pressure less than the minimum 10,000 pound per square inch pressure sometimes used with the hand-held spray guns.

SUMMARY OF THE INVENTION

Despite the contrary opinions by those in the industry, we have developed an apparatus and method for cleaning cyclone burners in a manner which meets the aforementioned needs. The present invention cleans a cyclone without using people inside the cyclone while the slag is being removed. Additionally, the present invention cleans more safely, more quickly, more precisely, and with less people than the aforementioned prior techniques so that the incidence of injury and the expenditures of time, effort and money are reduced. The present invention also accomplishes the cleaning with lower cleaning fluid pressures.

Generally, the apparatus of the present technique includes support means for providing a support adjacent an end wall of a cyclone, a carriage movably mounted on the support means, carriage movement means for moving the carriage toward and away from the end wall, conduit means for conducting a cleaning fluid into the cyclone, swivel means mounted on the carriage for rotating the conduit means, fluid lance means connected to the conduit means for rotational movement therewith for conducting the fluid from the conduit means, fluid lance movement means for moving the fluid lance means transversely to the conduit means, and nozzle means connected to the fluid lance means for creating a selectable one of a longitudinal spray and a transverse spray to clean the interior surfaces of the side wall, the end walls, and the inlet and outlet walls of the cyclone. In the preferred embodiment the nozzle means includes a pair of single directional port members, each of which is connectible to a respective one of two pipes included in the preferred embodiment of the fluid lance means. This pair creates radially outward streams of the fluid directed toward the side wall. This nozzle means also includes a pair of dual directional, longitudinal spray port members, each of which is connectible to a respective one of the outlets of the pipes of the fluid lance means for creating dual directional stream of the fluid simultaneously directed toward the two end walls of the cyclone. The nozzle means of the preferred embodiment still further includes a pair of dual directional, radial spray port members, each of which is connectible to a respective one of the outlets of the pipes for creating dual directional streams of the fluid simultaneously directed toward the inlet wall and the side wall in a first cleaning position and toward the outlet wall and the side wall in a second cleaning position.

The method of the present invention broadly includes supporting conduit means for conducting a fluid into the cyclone so that the conduit means extends into the cyclone through an opening in one of the end walls of the cyclone. In the preferred embodiment this conduit means includes a longitudinal pipe, a radial first fluid lance connected in fluid communication with the pipe and a radial second fluid lance connected in fluid communication with the pipe. The method further includes attaching a selectable pair of a plurality of nozzle means to the first and second fluid lances, flowing a cleaning fluid into the pipe and ejecting streams of the cleaning fluid through the selectable pair of nozzle means, and moving the pipes in the cyclone so that the slag is engaged by the streams of the cleaning fluid. More particularly, the step of attaching a selectable pair of nozzle means includes various steps of attaching each of the aforementioned different types of nozzles to the fluid lances during respective time periods; correspondingly, the step of moving the pipe includes moving the pipe through respective portions of the cyclone during the respective time periods so that a respective nozzle is used on a respective part of the cyclone during a corresponding time period. The method of the present invention also more particularly includes in the step of flowing the cleaning fluid, flowing the cleaning fluid at a pressure less than 10,000 pounds per square inch.

Therefore, from the foregoing, it is a general object of the present invention to provide a novel and improved hydroblast cyclone cleaner apparatus and method. Other and further objects, features and advantages of the present invention will be readily apparent to those skilled in the art when the following description of the preferred embodiment is read in conjuction with the accompanying drawings.

DETAILED DESCRIPTION OF THE PREFERRED EMBODIMENT

Figure 1:
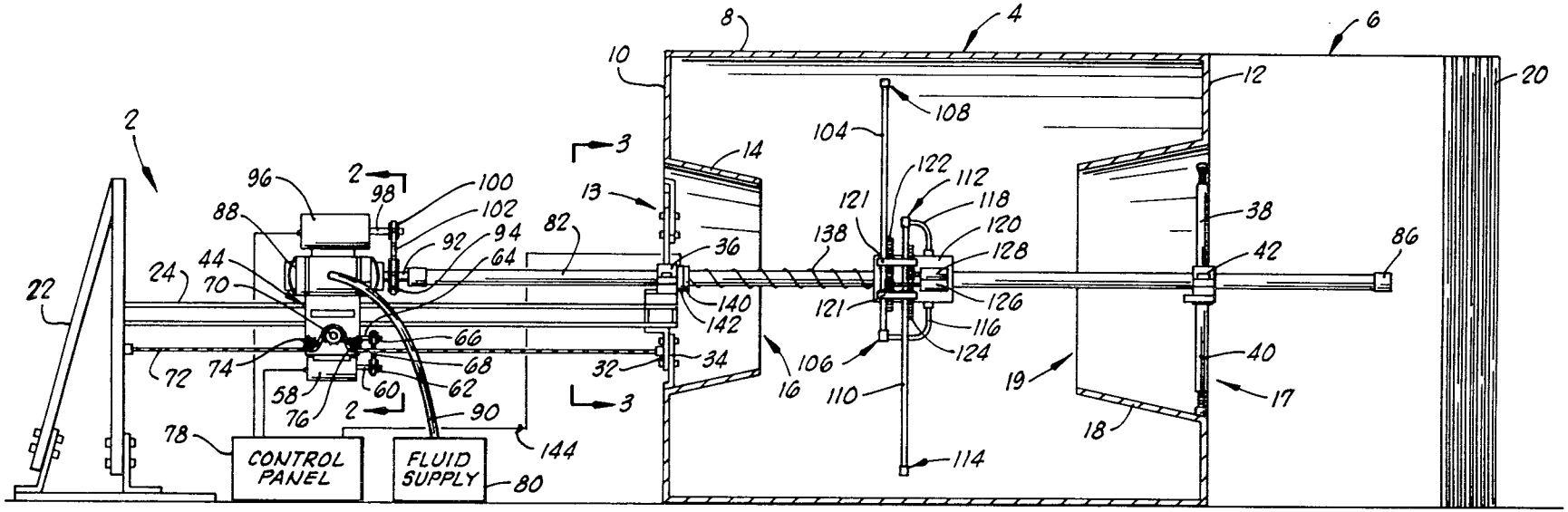
FIG. 1 is a schematic elevational view, partially in section, of the apparatus of the present invention associated with a cyclone burner.

With reference initially to FIGS. 1–7, the preferred embodiment of an apparatus 2 constructed in accordance with the preferred embodiment of the present invention will be described. FIG. 1 shows the apparatus 2 is associated with a cyclone 4 disposed adjacent a boiler 6.

The cyclone 4 and the boiler 6 are of constructions as known to the art, such as of the types manufactured by Babcock and Wilcox for use by utility companies (although this specific type is referred to herein, it is contemplated that the present invention can be used with other types of cyclones used for other purposes). In particular, the cyclone 4 is shown in FIG. 1 to include a cylindrical side wall 8 which is 10–15 feet long with a 10-foot diameter, for example. Although not shown in these schematic illustrations, the cylindrical side wall 8 has an air inlet duct of a type as known to the art for receiving and creating the cyclonic air flow within the interior of the cyclone 4.

The side wall 8 terminates at one end with an annular end wall 10 and at the other end with an annular end wall 12. The end wall 10 defines an inlet opening 13 about which extends an inlet wall 14 having the shape of a frustrum of a cone. The frusto-conical inlet wall 14 has at the base of its shape an outer mouth which corresponds to the inlet opening 13, and the wall 14 has at the apex of its shape an inner mouth 16 which opens into the interior of the cyclone 4. During normal operation of the cyclone 4, pulverized coal is fed via a conveyor apparatus of a type as known to the art (not shown) into the inlet opening 13 and through the mouth 16 for initial combusting in, and cyclonic transportation through, the cyclone 4. The end wall 12 defines an outlet opening 17 about which a frusto-conical outlet wall 18 extends inwardly into the interior of the cyclone 4 towards the inlet wall 14. The outlet opening 17 defines an outer mouth at the base of the frustrum shape of the wall 18. At the apex of the shape of the wall 18 there is defined an inner mouth 19 through which the partially combusted, cyclonically moved coal is moved into the boiler 6.

The aforementioned walls of the cyclone 4 are defined by a plurality of tubes through which water circulates for being heated by the combusted coal as the coal flows through the cyclone 4 from the inlet to the outlet as known to the art. Short stubs are attached to the tubes for defining the desired depth to which the slag, which is formed by the combusting of the coal, should be deposited for assisting the combustion process. For purposes of simplicity, these parts of the cyclone 4 are not shown, but they are known to the art. Also known to the art but not shown in the drawings is a slag tap or drain disposed in the outlet end wall 12 for allowing the dislodged slag to be removed from the interior of the cyclone 4. As known to the art, some of the removed slag is also dispersed through the outlet opening 17 and into the boiler 6 for removal therefrom.

As previously mentioned, the boiler 6 is of a suitable construction as known to the art. This construction includes a plurality of tubes, a few of which tubes are illustrated in FIG. 1 and indentified by the reference numeral 20. Although not shown in the drawings, the boiler 6 includes a burner device located in the bottom for producing a flame which further combusts the coal cyclonically moved through the cyclone 4 and into the boiler 6 during normal operation of the cyclone 4 and boiler 6.

The apparatus 2 which is used to clean the cyclone 4 includes support means for providing a support adjacent the end wall 10 in the illustrated preferred embodiment. The support means includes a base comprising a vertical standard 22 and a horizontal longitudinal beam 24. The depicted vertical standard 22 of the preferred embodiment is a tripod which is adjustable for accommodating different positions of the beam 24 depending upon the size of the cyclone with which the apparatus 2 is used during any particular job. In the preferred embodiment the beam 24 is an I-beam which is removably retained at one end to the vertical standard 22 by suitable means known to the art and which is removably retained at its other end adjacent the inlet opening 13. This latter end of the beam 24 is supported at the end wall 10 by three strut elements 26, 28, 30.

Figure 3:
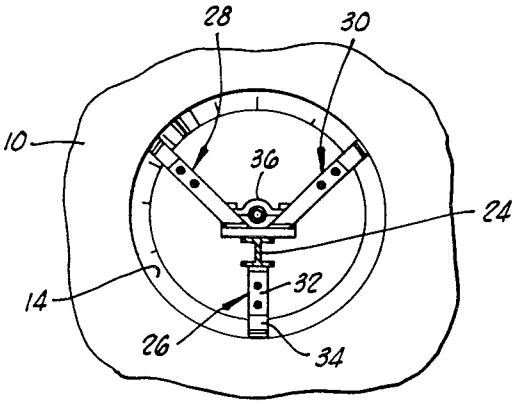
FIG. 3 is a partial end view taken along line 3—3 shown in FIG. 1.

Each of the strut elements 26, 28, 30 of the preferred embodiment includes two slidably related plates which are pinned or bolted together at selectable positions. This is best illustrated in FIGS. 1 and 3 wherein it is shown that the strut element 26 includes a sliding plate member 32 having a horizontally extending flange upon which the beam 24 rests. The strut 26 also includes a plate member 34 which engages the end wall 10. The plates 32 and 34 are shown bolted together in a selectable position dependent upon the size of the opening in the end wall 10 and the desired relative position of the I-beam 24 thereto. The strut elements 28, 30 are similarly constructed to support the beam 24 through engagement with the end wall 10. This engagement is in a manner similar to that used for retaining the pulverized coal conveyor apparatus to the inlet of the cyclone 4. For example, this could be by bolting the member 34 of the strut element 26 and the corresponding members of the strut elements 28, 30 to the flanged edge of the end wall 10 defining the inlet opening. In the preferred embodiment, the strut elements 26, 28, 30 function as stabilizers for stabilizing and retaining the beam 24 near the center longitudinal axis of the cylindrical cyclone 4.

Also forming a part of the support means of the preferred embodiment is a bearing member 36 of a suitable type known to the art. The bearing member 36 has a housing which is supported on the beam 24 and by the struts 28, 30.

The support means also includes an outlet support structure show in FIG. 1 as including struts 38, 40 and a bearing member 42 of types as known to the art. Each of the struts 38, 40 is particularly shown as including a telescoping member having a first element threadedly engaged within an outer tube for adjusting the length of the strut. This outlet support structure also includes other struts similar to the struts 38, 40, although they do not appear in the schematic sectional view shown in FIG. 1.

Figure 2:
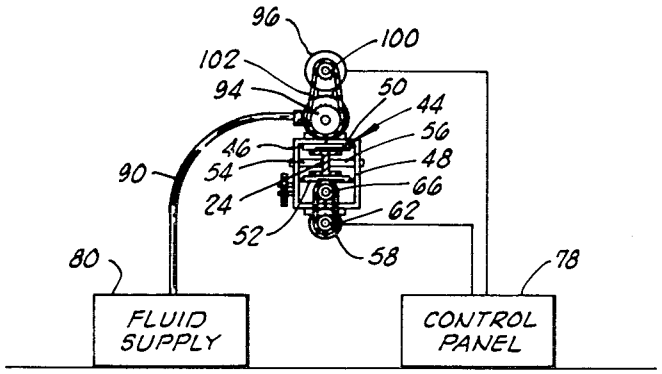
FIG. 2 is an end view taken along line 2—2 shown in FIG. 1.

The apparatus 2 also includes a carriage 44 movably mounted on the beam 24. In the preferred embodiment, the carriage 44 includes two substantially C-shaped pieces 46, 48 which are suitably pinned together at top and bottom retaining flanges. Rotatably retained between the coupled sections 46, 48 are a plurality of suitable rollers 50, 52 which assist the relative movement between the carriage 44 and the beam 24. To stabilize the carriage 44 for preventing rotational movement of the carriage 44 relative to the beam 24, the carriage also includes adjustable members 54, 56, such as support brackets and bolts, which can be adjusted against the connecting web of the beam 24 as illustrated in FIG. 2.

The apparatus 2 also includes carriage movement means for moving the carriage 44 relative to the beam 24. This movement is in two directions along the length of the beam 24 so that the carriage 44 can be moved toward and away from the end wall 10. In the illustrated preferred embodiment, the carriage movement means includes a suitable electric motor 58 connected by suitable means to the underside of the carriage 44. The motor 58 has a drive shaft 60 to which a pulley or gear 62 is connected for rotating with the drive shaft 60. The carriage movement means also includes gear means for being driven by the motor 58. The gear means of the preferred embodiment includes a driven shaft 64 having a pulley or gear 66 attached thereto. The pulley 66 and the pulley 62 are rotatably associated by means of a drive belt or chain 68. The driven shaft 64 is connected to a main gear 70 which engages a stationary chain 72 by means of retaining gears 74, 76. The chain 72 is fixed at one end to the vertical standard 22 and at the other end to the strut element 26. The motor 58 is controlled at a control panel 78 in a manner as known to the art for driving the motor 58 in either of two directions which in turn drives the gear 70 in either of two directions, thereby causing the carriage 44 to move in either of two directions along the beam 24.

The control panel 78 is any suitable device for connecting the various operative parts of the apparatus 2 to energy sources (e.g., electric or pneumatic) as would be readily known or apparent to those skilled in the art. The control panel 78 is positioned outside of the cyclone 4 so that all control of the apparatus 2 during slag removal is accomplished by an operator located at a safe distance from the cyclone 4.

The apparatus 2 also includes conduit means for conducting a cleaning fluid from a suitable fluid source such as a fluid supply 80 shown in FIG. 1. The conduit means of the FIG. 1 embodiment includes a 2-inch pipe 82 extending longitudinally through the cyclone 4 substantially along the central axis of the cylindrical shape. The pipe 82 is journaled by the bearings 36, 42 so that the pipe 82 can rotate. The pipe 82 is in two sections which are coupled together by a 2-inch cross connector 84 of a type as known to the art. The cross connector 84 forms another part of the conduit means. The pipe 82 has a length which is greater than the length of the cyclone 4 so that one end of the pipe 82 extends out of the inlet opening 13 and the other end of the pipe 82 extends out of the outlet opening 17 into the boiler 6. This latter end of the pipe is closed by a suitable cap member 86. The former end of the pipe 82 is connected in fluid communication with a swivel means forming another part of the apparatus 2.

The swivel means of the preferred embodiment includes a fluid conductive swivel 88 of a type as known to the art. The swivel 88 is suitably secured to the carriage 44. The swivel 88 has a fluid inlet port which is connected to a flexible hose 90 extending from the fluid supply 80. The swivel 88 also includes a rotatable fluid outlet port 92 which is coupled to the pipe 82 in a manner as known to the art. Also connected to the outlet port 92 is a pulley or gear 94 which is driven by a pneumatic motor 96 having a drive shaft 98 with a pulley or gear 100 mounted thereon, which pulley or gear 100 is connected to the pulley or gear 94 by a drive belt or chain 102. The pneumatic motor 96 is controlled at the control panel 78 through an air valve which, when opened, allows air to drive the pneumatic motor 96, thereby rotating the outlet port 92 and the pipe 82 connected thereto.

The apparatus 2 also includes fluid lance means, connected to the conduit means for rotational movement therewith, for conducting the fluid from the conduit means outwardly into the interior of the cyclone 4 for engaging the slag deposits. In the preferred embodiment the fluid lance means includes one fluid lance made of a half-inch pipe 104 extending radially outwardly from the pipe 82. The pipe 104 has an inlet end 106 and an outlet end 108. The fluid lance means of the preferred embodiment also includes another fluid lance made of a half-inch pipe 110 having an inlet end 112 and an outlet end 114. The pipe 110 extends radially outwardly from the pipe 82 so that the outlet end 114 opens in a direction opposite the outlet end 108 of the pipe 104. The fluid lance means of the preferred embodiment also includes suitable fluid coupling means for coupling the pipes 104, 110 in fluid communication with the pipe 82. One of the fluid coupling means of the preferred embodiment includes a half-inch flexible hose 116 which is connected between one outlet of the cross member 84 and the inlet end 106 of the pipe 104. The other fluid coupling means includes a half-inch flexible hose 118 which is connected between the other outlet of the cross member 84 and the inlet end 112 of the pipe 110. The pipes 104, 110 are retained on a support plate 120 by suitable retainer means (such as brackets 121 illustrated in FIGS. 1 and 4) for enabling the pipes 104, 110 to be moved relative to the support plate 120.

To effect the movement of the pipes 104, 110, the apparatus 2 includes fluid lance movement means for moving the fluid lances transversely to the conduit means. The fluid lance movement means of the preferred embodiment includes the support plate 120 which is secured to the cross member 84 by suitable means known to the art. Suitably mounted on the plate 120 in sliding relationship thereto is a first rack member 122 which is connected to the fluid lance pipe 104. Also slidably associated with the plate 120 is another rack element 124 which is connected to the fluid lance pipe 110. Each of the rack elements 122, 124 has an upwardly facing toothed surface. To drive the racks 122, 124, the fluid lance movement means also includes two electric motors 126, 128. The motor 126 has a drive shaft 130 to which a pinion gear 132 is connected in engagement with the upwardly facing toothed surface of the rack 122. The motor 128 has a similar drive shaft 134 to which a pinion gear 136 is connected in engagement with the upwardly facing toothed surface of the rack 124. The motors 126, 128 are connected to respective control wires 138.

The control wires 138 are wrapped around the pipe 82 and extend toward the bearing 36 as shown in FIG. 1. The control wires connect to a strike plate 140 secured to the pipe 82 for rotation therewith. The strike plate 140 electrically engages another strike plate 142 which is fixed to the housing of the bearing 36 so that the strike plate 142 is maintained stationary when the pipe 82 rotates. The strike plate 142 is electrically connected to the control panel 78 by suitable conductor means 144. This type of electrical connection enables a person at the control panel 78 to control the motors 126, 128, and yet it prevents the needed electrical conductors from becoming wrapped and unwrapped during rotation of the pipe 82.

To avoid any possible maintenance problems arising from the use of electric motors in an environment where liquid such as water is being sprayed, it is contemplated that the present invention could incorporate pneumatic motors, for example, in place of the electrical motors 126, 128. These alternative motors would be actuated by a suitable non-electrical driving force, thereby obviating the need for the strike plates 140, 142. For example, a swivel also having an air inlet port could be used in place of the swivel 88. This alternative swivel would have the pipe 82 connected to it in the same manner as to the swivel 88; however, the pipe 82 would be concentrically disposed within an outer pipe secured to the pipe 82, such as by set screws. This outer pipe would extend through, and be journaled in, the bearing 36 and would define an annulus about the portion of the inner pipe 82 which is within the outer pipe. Air hoses would be disposed in this annulus to communicate air from the air inlet port of the swivel to the pneumatic motors on the plate 120. The portion of these hoses extending beyond the end of the outer pipe could be wrapped around the pipe 82 in a manner similar to the wires 138. It is contemplated that other types of motors and drive means can be used.

Figure 4:
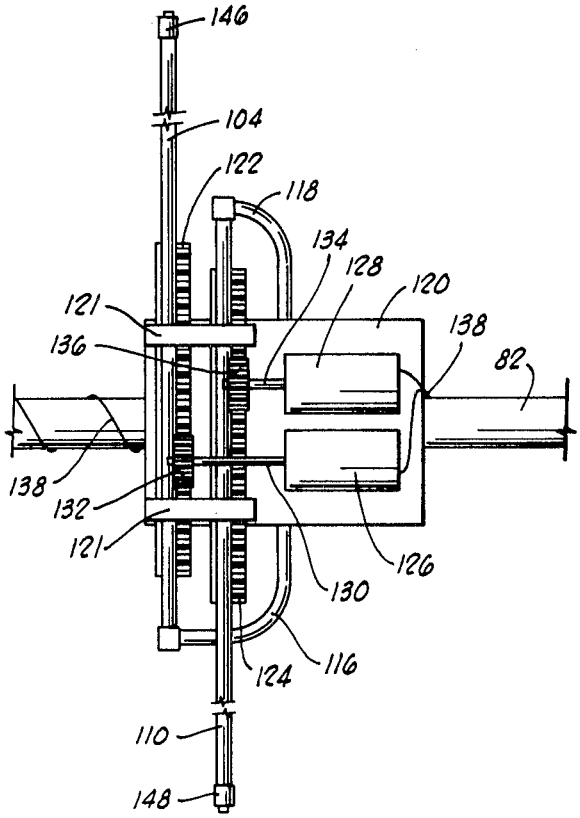
FIG. 4 is a top plan schematic view of the fluid lance means and fluid lance movement means of the preferred embodiment of the present invention.
Figure 5:
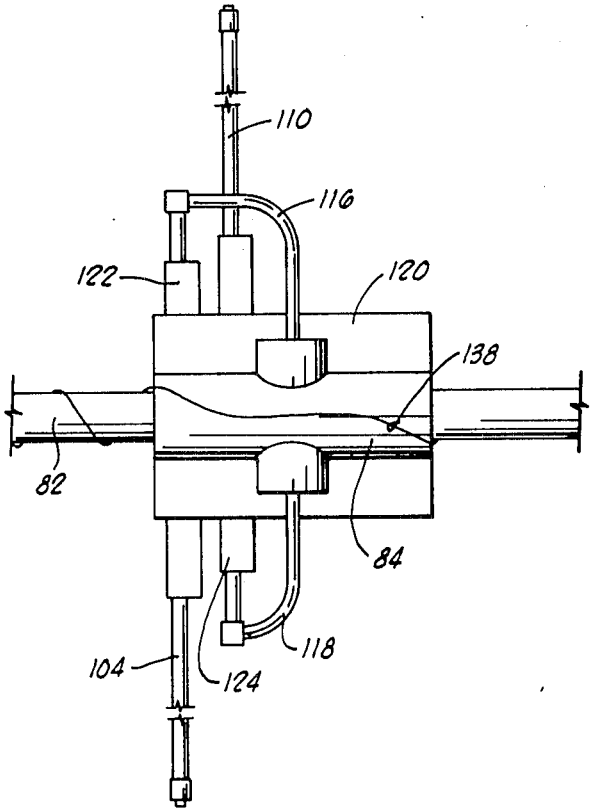
FIG. 5 is a bottom plan view of the apparatus shown in FIG. 4.

The apparatus 2 still further includes nozzle means, connected to the fluid lances 104, 110, for creating a selectable spray which is selectable dependent upon which part of the cyclone 4 is to be cleaned. In the preferred embodiment, the nozzle means includes three different nozzles, or pairs of nozzles, as best shown in FIGS. 4–12. As shown in FIGS. 4 and 5, one pair of nozzles includes a pair of single directional port members 146, 148. The member 146 is threadedly connected to the outlet end 108 of the pipe 104, and the member 148 is threadedly connected to the outlet end 114 of the pipe 110. Each of the members 146, 148 provides a single directional spray which in the preferred embodiment ejects the cleaning fluid in a substantially radial direction coaxially to the fluid lance to which it is connected. In the preferred embodiment it is contemplated that the sprays will be ejected from approximately ¼-inch outlet spray ports of the members 146, 148. Specifically, it is contemplated that the port size is to be 3/16-inch or ¼-inch; however, other sizes can be used.

Figure 6:
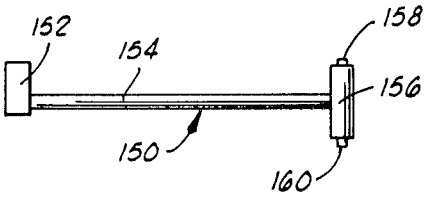
FIG. 6 is a view of one type of nozzle of the preferred embodiment of the present invention.
Figure 11:
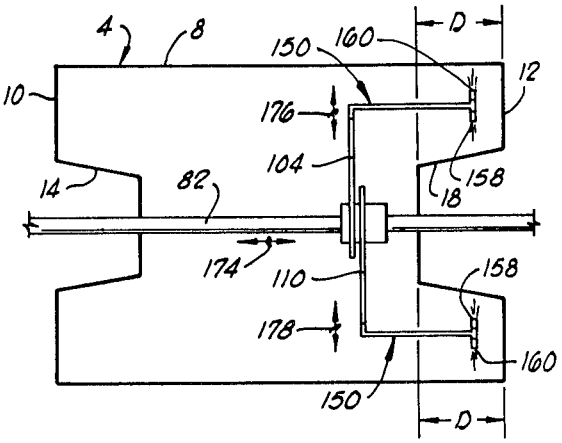
FIG. 11 is a schematic plan view of the present invention cleaning an area D of the cyclone.
Figure 9:
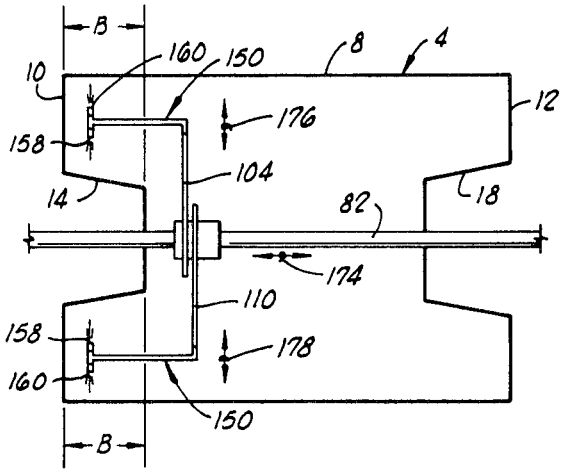
FIG. 9 is a schematic plan view of the present invention cleaning an area B of the cyclone.

Another element of the nozzle means of the preferred embodiment of the present invention is shown in FIG. 6. FIG. 6 shows a dual directional, radial spray port member or nozzle 150 having an elbow portion 152 which is threadedly connectible to the outlet end 108 of the pipe 104 in place of the member 146. Extending from the elbow portion 152 is a straight section 154 which terminates in a transverse head 156 having spray ejection ports 158, 160. In the preferred embodiment the spray ports 158, 160 are contemplated to have ⅛-inch diameters; however, other sizes can be used. When the nozzle 150 is connected to the pipe 104, the ports 158, 160 eject the cleaning fluid in opposite directions which are transverse to the straight section 154 and which are transverse to the cyclone 4 when the nozzle 150 is connected to one of the fluid lances. A second nozzle similar to the nozzle 150 is connectible to the outlet end 114 of the pipe 110 in place of the member 148 as illustrated in FIGS. 9 and 11.

Figure 7:
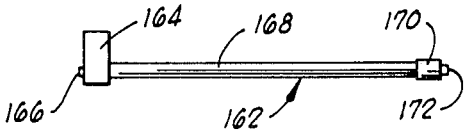
FIG. 7 is a view of another type of nozzle of the preferred embodiment of the present invention.

FIG. 7 illustrates a nozzle 162 forming another part of the nozzle means of the preferred embodiment of the present invention. The nozzle 162 has an elbow portion 164 having a spray port 166. Extending from the elbow portion 166 is a straight portion 168 terminating in an end portion 170 having a port 172 spaced longitudinally from the port 166. The ports 166, 172 provide oppositely directed longitudinal sprays of the cleaning fluid when the nozzle 162 is connected to the outlet end 108 of the pipe 104. It is contemplated that the ports 166, 172 of the preferred embodiment will have ⅛-inch diameters; however, other sizes can be used. A similar nozzle is connectible to the outlet end 114 of the fluid lance 110.

In the preferred embodiment of the present invention, a selectable one of the three pairs of nozzles illustated in FIGS. 4–7 is connected to the fluid lances 104, 110 during different periods of the cleaning process performed by the present invention. This will be more particularly described hereinbelow.

In the preferred embodiment of these three pairs of nozzles, effective cleaning can be accomplished if the outlet spray ports have approximately ¼-inch diameters and the fluid is ejected at a pressure of approximately 4,500 to 5,000 pounds per square inch or if the ports have approximately ⅛-inch diameters and the fluid is ejected at a pressure of approximately 7,000 pounds per square inch. It is contemplated that other sizes of ports and pressures can be utilized in the present invention. These ports are generally larger than ports of the spray guns used in the prior techniques, but with reduced pressure flows ejected therefrom. Such construction enables the present invention to provide stronger cleaning forces than could be used with handheld spray guns, but with smaller fluid pressures. Such stronger cleaning forces permit quicker cleaning of the cyclone.

Although not illustrated, the apparatus 2 can also include a cover means of any suitable type for draping over the inlet opening 13 to prevent the loosened slag from flying out of the inlet opening 13 as the apparatus 2 works to remove the slag from the inner surfaces of the cyclone 4.

With reference primarily to FIGS. 8–12, the operation and methodology of the present invention will be described. Initially, it is to be noted that the cyclone 4 as schematically represented in FIGS. 8–12 can be divided into five cleaning areas. These cleaning areas are denoted by the letters A, B, C, D, E in FIGS. 8–12, respectively. The area A is defined by the inner surface of the annular inlet end wall 10. This annular area extends between the junctions of the end wall 10 with the side wall 8 and with the inlet wall 14. The area B includes the portion of the side wall 8 and the inner surface of the inlet wall 14 defining the outer and inner radial boundaries, respectively, of a substantially annular space which is longitudinally bounded by the end wall 10 and the plane which includes the inner mouth 16 of the inlet wall 14. The area of this latter boundary is the difference between the diameter of the side wall 8 and the diameter of the inner mouth 16 of the inlet wall 14.

The area C is that portion of the side wall 8 extending between the inner mouth 16 of the inlet wall 14 and the inner mouth 19 of the outlet wall 18.

The area D includes that portion of the side wall 8 and the outlet wall 18 which define the outer and inner radial boundaries, respectively, of a substantially annular space which corresponds to the aforementioned substantially annular space associated with the area B.

The area E is defined by the inner surface of the annular end wall 12 extending between the junctions of the end wall 12 with the side wall 8 and with the outlet wall 18.

Although the following description of the steps by which these five areas are cleaned will be described in the sequence illustrated in the order set forth in FIGS. 8–12, the cleaning can be effected through any suitable order of the steps.

To clean area A, the nozzles 162 having the longitudinally opposite sprays are attached one to each of the outlet ends of the fluid lances 104, 110. This can be accomplished by a person entering the cyclone 4 and making the necessary threaded connections between the nozzles and the fluid lances. Once the nozzles have been attached in the direction shown in FIG. 8, wherein the straight sections 168 are parallel to the pipe 82 and the spray ports 172 face the end wall 10, the person exits the cyclone 4.

Figure 8:
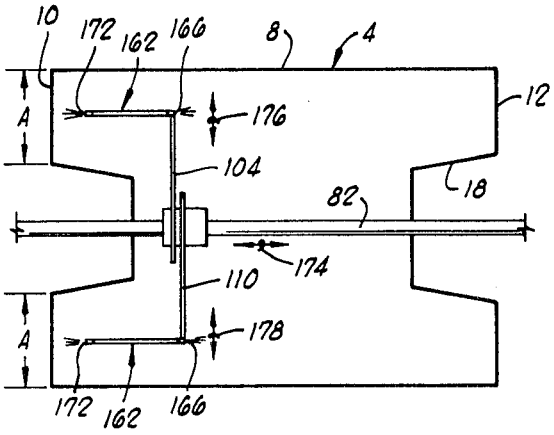
FIG. 8 is a schematic plan view of the present invention cleaning an area A of the cyclone.

This person, or another person, locates himself or herself at the control panel 78 to effect the remaining steps of the procedure for cleaning area A. This procedure includes actuating a switch at the control panel to connect the motor 58 to a source of electricity for moving the carriage 44 and the apparatus connected thereto to a position as shown in FIG. 8 wherein the outwardmost (leftwardmost as viewed in FIG. 8) spray ports 172 are located adjacent the slag deposited on the area A. Once the carriage 44 is properly positioned, the motor 58 is de-energized. The movement of the carriage 44 effects movement of the fluid lances in either of the two longitudinal directions denoted in FIG. 8 by the arrows labled with the reference numeral 174.

With the carriage 44, and thus the fluid lances 104, 110 and nozzles 162 connected thereto, properly positioned, the person at the control panel 78 opens a control valve to supply air pressure to the pneumatic motor 96 which rotates the outlet port 92 of the swivel 88 and the pipe 82 connected thereto. Because the plate 120 is fixed to the pipe 82, the lances 104, 110 mounted on the plate 120 likewise rotate with the pipe 82. This rotation causes the two spray ports of the nozzles 162 to move in a circular pattern. The cleaning fluid is pumped by suitable pump means associated with the fluid supply 80 through the hose 90, the swivel 88, the pipe 82, the cross member 84, the hoses 116, 118, the fluid lances 104, 110, and the nozzles 162 for ejection through the spray ports 166, 172. The sprays from the ports 172 loosen the slag along the circular path defined by the rotating elements. The oppositely directed sprays ejected from the ports 166 of the nozzles 162 act as countering forces to prevent the lances 104, 110 from bending, which would otherwise occur if only the sprays from the ports 172 occurred.

When a circular path has been adequately cleaned, the person at the control panel 78 stops the fluid flow and the rotation. Thereafter, the person actuates a suitable control switch at the control panel 78 to energize the motors 126, 128 to extend or retract the fluid lances 104, 110 in either of the transverse (more specifically to the preferred embodiment, radial) directions denoted in FIG. 8 by the arrows labeled with the reference numerals 176, 178. It is to be noted that the motors 126, 128 are suitably connected via the conductors 138 so that when one or more switches at the control panel 78 is or are actuated, the motors 126, 128 rotate in the proper direction to either both extend the fluid lances 104, 110 or retract both fluid lances, 104, 110. Of course, rather than starting at some middle location, the fluid lances 104, 110 can initially be placed at either a radially outermost or radially innermost position to clean that respective circular area and then be sequentially stepped inwardly or outwardly to sequentially clean adjacent circular paths of the deposited slag.

Once the foregoing steps have been repeated to remove a layer of the slag with the carriage 44 located in its initial position, the carriage 44 is then moved to the left (as viewed in FIG. 8) so that the nozzles 162 are moved closer to the remaining slag if an insufficient layer of slag was initially removed. That is, if the slag deposit has a thickness which is greater than can be cleaned from a single longitudinal position of the lances 104, 110, then the lances 104, 110 must be sequentially moved closer to each subsequentially exposed underlying layer of the slag until the desired amount of slag remains on the surface having the area A.

Figure 12:
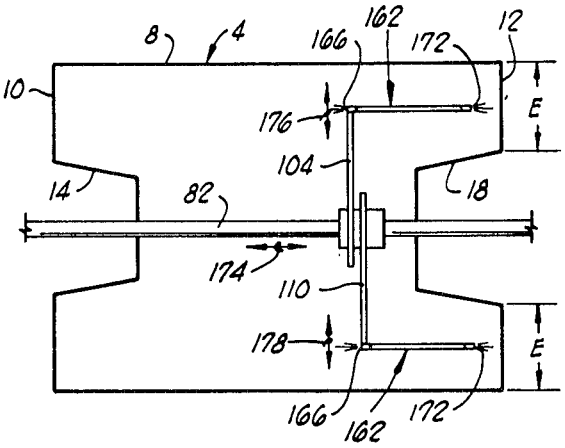
FIG. 12 is a schematic plan view of the present invention cleaning an area E of the cyclone.
Figure 10:
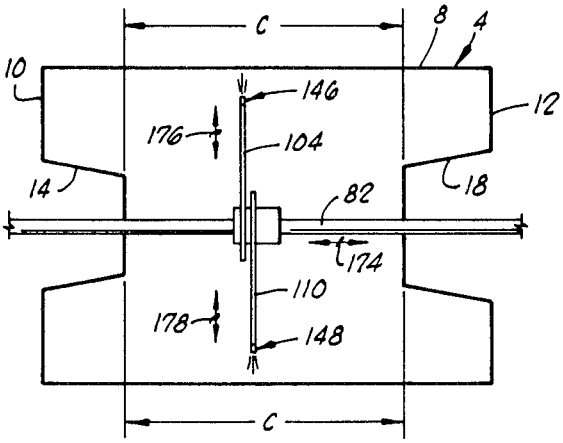
FIG. 10 is a schematic plan view of the present invention cleaning an area C of the cyclone.

Once the area A has been sufficiently cleaned, a person can re-enter the cyclone 4 and either rotate the nozzles 162 to the position shown in FIG. 12 for cleaning the area E or the nozzles 162 can be removed and another type of nozzle connected for cleaning the area B or area C or area D. Because this description is made in the illustrated order of FIGS. 8–12, it will be assumed that the nozzles 162 are removed and that the nozzles 150 are connected and directed as shown in FIG. 9, wherein the straight portions 154 are parallel to the pipe 82, so that area B can be cleaned. To effect this cleaning, the motor 58 is actuated at the control panel 78 so that the spray head portions 156 of the nozzles 150 are disposed in the substantially annular region bounded by the area A. This positioning permits the radially outermost spray ports 160 to eject a spray toward the slag deposited on the side wall 8 while the innermost spray ports 158 direct the spray onto the slag deposited on the inlet wall 14. The pipe 82 is rotated so that circular paths are cleaned on these surfaces. The carriage 44 and the fluid lances 104, 110 are moved longitudinally and radially to position the spray head portions 156 at selected positions within the substantially annular space. It may be that in some cyclones, the fluid lances 104, 110 can be retained at a single radial disposition and simply moved longitudinally, whereas in other cyclones the fluid lances may need to be moved both longitudinally and radially so that the sprays are moved closer to either the deposits on the outer side wall 8 or those on the inlet wall 14. Regardless of how the fluid lances 104, 110 are manipulated, they are so manipulated externally of the cyclone 4 at the control panel 78.

Once the area B surfaces have been cleaned, a person enters the cyclone 4 and either moves the nozzles 150 to the positions shown in FIG. 11 so that the area D can be cleaned, or another pair of the nozzles is attached. In considering FIG. 10 next, it will be assumed that the person removes the pair of nozzles 150 and attaches the pair of nozzles 146, 148 to achieve single radial sprays directed toward the side wall 8.

To clean the area C, the carriage 44 is moved so that the fluid lances 104, 110 are positioned at a selected place along the length of the area C. For example, the carriage 44 could be moved so that the fluid lances 104, 110 are at the leftmost boundary of the area C adjacent the inner mouth 16 of the inlet wall 14. The fluid lances 104, 110 are moved so that the nozzles 146, 148 are near the surface of the slag deposited on the area C. The pipe 82 is then rotated and fluid ejected from the nozzles so that a circular path is cleaned from the area C. The carriage 44 is then sequentially stepped towards the other boundary of the area C adjacent the inner mouth 19 of the outer wall 18 so that subsequent circles are cleaned. These steps are repeated, with the fluid lances 104, 110 being extended radially outwardly to remove subsequent layers of the slag. As with the previous steps described with reference to FIGS. 8 and 9, the foregoing steps can be done in any suitable order whereby the layers of slag are removed.

Once the area C has been cleaned, the nozzles 146, 148 are removed and one of the other pairs of nozzles connected to effect cleaning of either the area D or the area E if they have not been previously cleaned. To clean these areas D and E, the steps described with reference to areas A and B, respectively, are repeated except for positioning the respective nozzles in the positions shown in FIGS. 11 and 12.

It has been found that the foregoing method can adequately clean a cyclone when nozzles having approximately ¼-inch ports are used with a cleaning fluid flowed at a pressure of less than 6,000 pounds per square inch or when nozzles having approximately ⅛-inch ports are used with a cleaning fluid flowed at a pressure less than 8,000 pounds per square inch.

From the foregoing, it is apparent that the present invention utilizes a plurality of nozzle means which are connected to the apparatus during their own respective time periods of usage to effect cleaning of respective portions of the cyclone 4 during these respective time periods.

Although the foregoing has been described with reference to a person positioned at the control panel 78 manually actuating the various control switches or valves, it is contemplated that the present invention can be substantially fully automated to function under control of a suitably programmed computer, for example.

With the foregoing apparatus and method, cyclone burners can be effectively cleaned in a consistent, thorough manner. This cleaning can be effected more safely, more quickly, more precisely, more economically and with lower fluid flow pressures than has been previously thought possible. Thus, the present invention is well adapted to carry out the objects and attain the ends and advantages mentioned above as well as those inherent therein. While a preferred embodiment of the invention has been described for the purpose of this disclosure, numerous changes in the construction and arrangement of parts can be made by those skilled in the art, which changes are encompassed within the spirit of this invention as defined by the appended claims.

What is claimed is:

1. An apparatus for cleaning a cyclone with a fluid from a fluid source, said cyclone including a side wall, a first end wall having an inlet opening, a second end wall having an outlet opening, an inlet wall extending inwardly from said first end wall and spaced from said side wall, and an outlet wall extending inwardly from said second end wall and spaced from said side wall, said apparatus comprising:

support means for providing a support adjacent said first end wall;

a carriage movably mounted on said support means;

carriage movement means for moving said carriage toward and away from said first end wall;

conduit means for conducting said fluid into said cyclone;

swivel means, mounted on said carriage, for rotating said conduit means;

fluid lance means, connected to said conduit means for rotational movement therewith, for conducting said fluid from said conduit means;

fluid lance movement means for moving said fluid lance means transversely to said conduit means; and nozzle means, connectible to said fluid lance means, for creating a selectable one of a longitudinal spray to clean the interior surfaces of said first and second end walls and a transverse spray to clean the interior surfaces of said side wall, said inlet wall and said outlet wall.

2. The apparatus of claim 1, wherein:

said fluid lance means includes:

a first pipe having an inlet and an outlet, said first pipe movably mounted on said conduit means in transverse relation therewith;

first fluid coupling means for connecting said inlet of said first pipe in fluid communication with said conduit means;

a second pipe having an inlet and an outlet, said second pipe movably mounted on said conduit means with said outlet of said second pipe opening outward in a direction opposite to which said outlet of said first pipe opens; and second fluid coupling means for connecting said inlet of said second pipe in fluid communication with said conduit means; and said nozzle means includes:

a pair of single directional port members, each of which is connectible to a respective one of said outlets of said first and second pipes for creating a respective radially outward stream of said fluid directed toward said side wall;

a pair of dual directional, longitudinal spray port members, each of which is connectible to a respective one of said outlets of said first and second pipes for creating dual directional streams of said fluid simultaneously directed toward said first and second end walls; and a pair of dual directional, radial spray port members, each of which is connectible to a respective one of said outlets of said first and second pipes for creating dual directional streams of said fluid simultaneously directed toward said inlet wall and said side wall in a first cleaning position and toward said outlet wall and said side wall in a second cleaning position.

3. The apparatus of claim 2, wherein said fluid lance movement means includes:

first rack means connected to said first pipe;

second rack means connected to said second pipe;

motor means mounted on said conduit means;

first pinion means, connected to said motor means, for engaging said first rack means; and second pinion means, connected to said motor means, for engaging said second rack means.

4. The apparatus of claim 3, wherein:

said motor means includes an electric motor; and said support means includes bearing means, retained near said inlet opening, for rotatably supporting said conduit means; and said apparatus further comprises:

first strike plate means, connected to said bearing means, for providing a stationary electrical contact;

second strike plate means, connected to said conduit means in electrically conductive association with said first strike plate, for providing a movable electrical contact; and electrical conductor means for electrically connecting said second strike plate to said electric motor.

5. The apparatus of claim 4, wherein:

said support means includes:

a vertical standard; and a horizontal beam having one end supported by said vertical standard and having another end connected to said first end wall adjacent said inlet opening, said beam having said carriage movably mounted thereon; and said carriage movement means includes:

a second motor means mounted on said carriage;

a chain disposed adjacent said beam between said ends thereof; and gear means for interconnecting said second motor means and said chain so that said carriage is moved along said beam in response to actuation of said second motor means.

6. A method of cleaning a deposit from the interior surfaces of a cyclone having a side wall, a first end wall having a first opening defined therein, an inlet wall extending inwardly from said first opening in spaced relation to said side wall, a second end wall having a second opening defined therein, and an outlet wall extending inwardly from said second opening toward said inlet wall in spaced relation to both said inlet wal and said outlet wall, said method comprising the steps of:

mounting inside of said cyclone a fluid lance means for directing a flow of cleaning fluid;

connecting said fluid lance means to a source of said cleaning fluid;

attaching to said fluid lance means drive means for moving said fluid lance means;

disposing outside of said cyclone control means for controlling said drive means;

flowing said cleaning fluid from said source through said fluid lance means; and actuating said control means for outside of said cyclone so that said drive means moves said fluid lance means within said cyclone as said cleaning fluid is flowing through said fluid lance means so that said cleaning fluid removes at least a portion of said deposit, said step of actuating said control means including:

moving said fluid lance means in a first direction extending longitudinally through said cyclone;

rotating said fluid lance means about said first direction; and moving said fluid lance means in a second direction, extending transversely to said first direction, as the thickness of the deposit is reduced by said flowing cleaning fluid.

7. The method of claim 6, wherein:

said step of mounting a fluid lance means includes attaching to said fluid lance means a nozzle having a port with an approximately ¼-inch diameter; and said step of flowing said cleaning fluid includes flowing said cleaning fluid through said port of said nozzle at a pressure of less than 6,000 pounds per square inch.

8. The method of claim 6, wherein said step of flowing said cleaning fluid includes flowing said cleaning fluid at a pressure less than 10,000 pounds per square inch.

9. The method of claim 6, wherein:

said step of mounting a fluid lance means includes attaching to said fluid lance means a nozzle having a port with an approximately $\frac{1}{8}$-inch diameter; and said step of flowing said cleaning fluid includes flowing said cleaning fluid through said port of said nozzle at a pressure of less than 8,000 pounds per square inch.

10. A method of cleaning a deposit from the interior surfaces of a cyclone having a side wall, a first end wall having a first opening defined therein, an inlet wall extending inwardly from said first opening in spaced relation to said side wall, a second end wall having a second opening defined therein, and an outlet wall extending inwardly from said second opening toward said inlet wall in spaced relation to both said inlet wall and said outlet wall, said method comprising the steps of:

mounting inside of said cyclone a fluid lance means for directing a flow of cleaning fluid, said step of mounting a fluid lance means including the steps of:

attaching to said fluid lance means, during a first time period, a first nozzle means for directing the flow of said cleaning fluid in two oppositely directed streams longitudinally within said cyclone;

attaching to said fluid lance means, during a second time period, a second nozzle means for directing the flow of said cleaning fluid in two oppositely directed streams transversely to the direction of the two oppositely directed streams of said first nozzle means; and attaching to said fluid lance means, during a third time period, a third nozzle means for directing the flow of said cleaning fluid in a single stream directed transversely to the direction of the two oppositely directed streams of said first nozzle means;

connecting said fluid lance means to a source of said cleaning fluid;

attaching to said fluid lance means drive means for moving said fluid lance means;

disposing outside of said cyclone control means for controlling said drive means;

flowing said cleaning fluid from said source through said fluid lance means; and actuating said control means from outside of said cyclone so that said drive means moves said fluid lance means within said cyclone as said cleaning fluid is flowing through said fluid lance means so that said cleaning fluid removes at least a portion of said deposit, said step of actuating said control means including the steps of:

moving said fluid lance means so that one of the two oppositely directed streams from said first nozzle means engages at least a portion of the deposit on said first end wall during said first time period;

moving said fluid lance means so that one of the two oppositely directed streams from said second nozzle means engages at least a portion of the deposit on said inlet wall during said second time period and so that the other of the two oppositely directed streams from said second nozzle means simultaneously engages at least a portion of the deposit on said side wall; and moving said fluid lance means so that the single stream from said third nozzle means engages another portion of the deposit on said side wall during said third time period.

11. The method of claim 10, wherein:

each of said first, second and third nozzle means includes a port with an approximately $\frac{1}{4}$-inch diameter; and said step of flowing said cleaning fluid includes flowing said cleaning fluid through the respective nozzle means during the respective time period at a pressure of less than 6,000 pounds per square inch.

12. The method of claim 10, wherein:

each of said first, second and third nozzle means includes a port with an approximately $\frac{1}{8}$-inch diameter; and said step of flowing said cleaning fluid includes flowing said cleaning fluid through the respective nozzle means during the respective time period at a pressure of less than 8,000 pounds per square inch.

13. A method of cleaning slag from the interior surfaces of a cyclone defined by a cylindrical side wall, a first end wall having a first opening defined therein, a substantially conical inlet wall extending inwardly from said first end wall adjacent said first opening so that a first substantially annular space is defined between said inlet wall and said side wall, a second end wall having a second opening defined therein, and a substantially conical outlet wall extending inwardly from said second end wall adjacent said second opening so that a second substantially annular space is defined between said outlet wall and said side wall, said method comprising the steps of:

supporting conduit means for conducting a fluid into said cyclone so that said conduit means extends into said cyclone through said first opening, said conduit means including a longitudinal pipe, a radial first fluid lance connected in fluid communication with said pipe, and a radial second fluid lance connected in fluid communication with said pipe;

attaching a selectable pair of a plurality of nozzle means to said first and second fluid lances;

flowing a cleaning fluid into said pipe and ejecting streams of the cleaning fluid through said selectable pair of nozzle means; and moving said pipe in said cyclone so that the slag is engaged by said streams of the cleaning fluid, including:

moving said first and second fluid lances in a first direction extending longitudinally through said cyclone;

rotating said first and second fluid lances about said first direction; and moving said first and second fluid lances in a second direction, extending transversely to said first direction, as the thickness of the deposit is reduced by said flowing cleaning fluid.

14. The method of claim 13, wherein:

said step of supporting conduit means includes:

disposing a base outside said cyclone adjacent said first end wall; and retaining near said first opening bearing means for rotatably receiving said pipe; and said step of moving said pipe includes:

slidably mounting on said base rotative movement means for rotating said pipe;

slidably mounting on said base linear movement means for imparting longitudinal movement to said pipe; and connecting to said rotative movement means and said linear movement means, outside of said cyclone, control means for controlling said rotative movement means and said linear movement means.

15. The method of claim 13, wherein said step of moving said pipe includes:

connecting to said pipe drive means for linearly and rotatably moving said pipe, said first and second fluid lances and said nozzle means within said cyclone from said first end wall, through said first substantially annular space, along said side wall, through said second substantially annular space, to said second end wall; and actuating said drive means from outside of said cyclone.

16. The method of claim 15, wherein said step of flowing a cleaning fluid includes flowing said cleaning fluid at a pressure less than 10,000 pounds per square inch.

17. A method of cleaning slag from the interior surfaces of a cyclone defined by a cyclindrical side wall, a first end wall having a first opening defined therein, a substantially conical inlet wall extending inwardly from said first end wall adjacent said first opening so that a first substantially annular space is defined between said inlet wall and said side wall, a second end wall having a second opening defined therein, and a substantially conical outlet wall extending inwardly from said second end wall adjacent said second opening so that a second substantially annular space is defined between said outlet wall and said side wall, said method comprising the steps of:

supporting conduit means for conducting a fluid into said cyclone so that said conduit means extends into said cyclone through said first opening, said conduit means including a longitudinal pipe, a radial first fluid lance connected in fluid communication with said pipe, and a radial second fluid lance connected in fluid communication with said pipe;

attaching a selectable pair of a plurality of nozzle means to said first and second fluid lances, including:

attaching to each of said first and second fluid lances, during a first time period, a respective one of a first pair of nozzles for providing longitudinal streams of the cleaning fluid, each respective one of said first pair having oppositely disposed ports facing said first and second end walls;

attaching to each of said first and second fluid lances, during a second time period, a respective one of a second pair of nozzles for providing transverse streams of the cleaning fluid, each respective one of said second pair having oppositely disposed ports facing said pipe and said side wall; and attaching to each of said first and second fluid lances, during a third time period, a respective one of a third pair of nozzles for providing radial streams of the cleaning fluid, each respective one of said third pair having a port facing said side wall;

flowing a cleaning fluid into said pipe and ejecting streams of the cleaning fluid through said selectable pair of nozzle means; and moving said pipe in said cyclone so that the slag is engaged by said streams of the cleaning fluid, including:

moving said pipe during said first time period so that one port of each of said first pair of nozzles is disposed near the slag on said first end wall and thereafter rotating said pipe during said first time period;

moving said pipe during said second time period so that each of said second pairs of nozzles is disposed in said first substantially annular space and thereafter rotating said pipe during said second time period; and moving said pipe during said third time period so that each of said third pairs of nozzles faces said side wall between said first and second substantially annular spaces and rotating said pipe during said third time period.

18. The method of claim 17, further comprising the steps of:

moving said first and second lances radially during said first time period so that both of said first pair of nozzles move laterally between said inlet wall and said side wall;

moving said first and second lances radially during said second time period so that both of said second pair of nozzles move laterally between said inlet wall and said side wall; and moving said first and second lances radially during said third time period so that both of said third pair of nozzles move toward said side wall as the thickness of the slag decreases.

19. The method of claim 17, wherein said step of moving said pipe further includes:

moving said pipe and said second pair of nozzles during a fourth time period so that each of said second pair of nozzles is disposed in said second substantially annular space and thereafter rotating said pipe during said fourth time period; and moving said pipe and said first pair of nozzles during a fifth time period so that one port of each of said first pair of nozzles is disposed near the slag on said second end wall and thereafter rotating said pipe during said fifth time period.

* * * * *